US006928901B1

(12) United States Patent
Rainin et al.

(10) Patent No.: US 6,928,901 B1
(45) Date of Patent: Aug. 16, 2005

(54) DEVICE FOR REMOVING A BROKEN LIGHT BULB FROM A SOCKET

(76) Inventors: Edgar A. Rainin, 111 Wild Oak Ct., Danville, CA (US) 94526; Judith W. Rainin, 111 Wild Oak Ct., Danville, CA (US) 94526

( * ) Notice: Subject to any disclaimer, the term of this patent is extended or adjusted under 35 U.S.C. 154(b) by 0 days.

(21) Appl. No.: 10/991,389

(22) Filed: Nov. 19, 2004

Related U.S. Application Data

(60) Provisional application No. 60/524,493, filed on Nov. 21, 2003, provisional application No. 60/525,709, filed on Nov. 28, 2003.

(51) Int. Cl.[7] ..... B25B 23/16
(52) U.S. Cl. ..... 81/53.1; 81/53.11; 81/53.12
(58) Field of Search ..... 81/53.1, 53.11, 81/53.12

(56) References Cited

U.S. PATENT DOCUMENTS

| | | | | |
|---|---|---|---|---|
| 1,319,028 A | | 10/1919 | Grinnell | |
| 1,819,028 A | * | 8/1931 | Kahn | 493/20 |
| 3,797,055 A | | 3/1974 | Greene | |
| 3,898,896 A | * | 8/1975 | Suhay | 81/441 |
| 4,485,701 A | * | 12/1984 | Hough | 81/64 |
| 5,103,695 A | | 4/1992 | Dolle et al. | |
| D350,262 S | * | 9/1994 | Fallon | D8/14 |
| D364,323 S | * | 11/1995 | Zupo et al. | D8/14 |
| 5,490,438 A | | 2/1996 | Zupo et al. | |
| 5,553,373 A | | 9/1996 | Sprayberry | |
| 5,937,714 A | | 8/1999 | Sherman et al. | |
| 6,260,442 B1 | * | 7/2001 | Bayat | 81/53.11 |

* cited by examiner

*Primary Examiner*—Joseph J. Hail, III
*Assistant Examiner*—Alvin J. Grant
(74) *Attorney, Agent, or Firm*—Theodore J. Bielen, Jr.

(57) ABSTRACT

A device for removing a hollow base of a broken light bulb utilizing a member terminating in an end surface which is capable of extending into the hollow base of a bulb. The member also includes a portion capable of receiving an applied torsional force. An adhesive band is fixed to the outer surface of the member. The adhesive band bonds with the hollow base of the broken light bulb to permit removal of the same via the torsional force.

12 Claims, 2 Drawing Sheets

DEVICE FOR REMOVING A BROKEN LIGHT BULB FROM A SOCKET

CROSS-REFERENCES TO RELATED APPLICATIONS

The present application is related to and claims the benefit of Provisional Patent Application 60/524,493, filed 21 Nov. 2003 and 60/525,709, filed 28 Nov. 2003.

BACKGROUND OF THE INVENTION

The present invention relates to a novel and useful device for removing a hollow base of a broken light bulb.

Incandescent light bulbs normally are constructed with a threaded metallic base portion that is threaded or screwed into a socket having a corresponding threaded portion. Over time, the bases of incandescent bulbs within sockets tend to seize up and are very difficult to remove when they expire. Compounding the problem is the fact that the glass portion of the incandescent bulb often breaks when grasped and twisted, adding to the difficulty of removing the metallic base of the incandescent bulb from the metallic socket.

In the past, removal of such bulbs required one or two pairs of pliers to grab the metallic base of the incandescent bulb in order to turn or unscrew the same from the socket. Such a task often required two persons, a ladder, and the disabling of the electric current to the incandescent bulb prior to the attempt to remove the same. In addition, remnants of the incandescent bulb had been removed with the pliers which caused damage to eyes of a person removing the bulb. Moreover, if the person removing the bulb forgets to turn off the electrical current to the lamp, the person removing the bulb may receive an electric shock through the metallic pliers.

Many systems have been proposed for removing the base of a broken light bulb from a socket. For example, U.S. Pat. Nos. 5,103,695 and 5,553,373 show light bulb and broken light bulb extractors in which a cup-like device is used to encompass the bulb or the bulb base to remove the same from a socket.

U.S. Pat. No. 3,797,055 describes a tool for removing light bulb bases in which brushes are placed on the end of an elongated member. Flanges are also intended to be inserted in a light bulb base to grip and remove the same from the socket.

U.S. Pat. Nos. 1,319,028, 3,898,896, and 5,937,714 teach incandescent lamp base removers in which flanges or teeth are employed to engage the interior of the base remaining in a light bulb socket. Removal is effected by a torsional or twisting action on the devices once the grip has been established by the teeth and the like.

U.S. Pat. Nos. 4,485,701, 5,490,438, 6,260,442, Des. 350,262, and Des. 364,323 show elongated tools in which an elastomeric or resilient tip is employed frictionally to engage the interior of a light bulb base remaining when the glass portion has been broken away. Again, a twisting or torsional motion is applied to the tool while force is applied longitudinally along the elongated member to remove the light bulb base from the socket.

A broken light bulb base removal device which is simple and reliable to use in a safe manner would be a notable advance in the field of industrial tools.

BRIEF SUMMARY OF THE INVENTION

The present invention provides for a novel and useful broken light bulb base removal device.

The device of the present invention is intended to be used manually by a person removing the base of a broken incandescent light bulb. The device of the present invention includes a member which is preferably elongated and terminates in an end having an outer surface which is capable of extending into the hollow base of the broken light bulb. The member may be formed of non-electrically conductive material such as plastic, wood, ceramic material and the like. The member may also take the form of a hollow tube such that the end extending into the hollow base of the broken light bulb accommodates remnants of a light bulb filament and stray glass. The remaining portion of the member includes a gripping surface for the user who is applying a torsional force to the member in its operation, which will be more fully discussed hereinafter. The member may also possess a certain degree of rigidity allowing the user to swing the same against the remaining filament and glass portions of the light bulb prior to removal of the base. In this manner, the end of the member is more easily inserted into the hollow base of the broken light bulb.

Adhesive means is also shown in the present invention and is applied to the outer surface of the end of the member. The adhesive means bonds with the hollow base of the broken light bulb such that the member and the adhesive means bonded to the hollow base of the broken light bulb all turn with the application of torsional force on the portion of the member gripped by the user. The adhesive means may take the form of a tape body possessing a first surface and an opposite second surface. The tape second surface is intended to be affixed to the end portion of the member, preferably by adhesive means. First surface of the tape body constructed with a first adhesive layer which contacts the hollow base of the broken light bulb. The tape may also be formed of a resilient material allowing a certain degree of deformation in the process of contacting the tape first adhesive layer on the first surface of the member, with the inner wall of the broken light bulb base. It should be understood that remnants of glass and cementitious or binding material may remain within the hollow chamber of the light bulb base, creating an irregular inner wall of the light bulb base. Such deformation allows the first adhesive layer to more readily conform to such irregular inner wall of the light bulb base of the broken light bulb and effect removal of the same by torsional force applied to the portion of the member gripped by the user. For example, the tape body may be fashioned from a polymeric foam material.

In addition, the portion of the member grip by the user may include an end portion that allows the attachment of extending devices, such as pole, to allow the user to remove a light bulb out of the normal reach of the user of the device of the present invention, obviating the need for a ladder or other height boosting implement.

It may be apparent that a novel and useful device for removing a hollow base of a broken light bulb from a socket has been hereinabove described.

It is therefore an object of the present invention to provide a device for removing the hollow base of a broken light bulb from a socket which is safe and easy to manipulate.

Another object of the present invention is to provide a device for removing a hollow base of a broken light bulb from a socket which is capable of clearing extraneous glass and filament material of the light bulb prior to use.

Another object of the present invention is to provide a device for removing a hollow base of a broken light bulb in which a resilient adhesive bearing element is used on the end of an elongated member which easily conforms to the irregular surface of the hollow interior of the base of the broken light bulb.

A further object of the present invention is to provide a device for removing a hollow base of a broken light bulb from a socket which is compatible with removal of the broken light bulb base connected to a closed electrical circuit.

Another object of the present invention is to provide a device for removing a hollow base of a broken light bulb from a socket which eliminates the direct touching of the broken light bulb base by the user of the device.

Yet another object of the present invention is to provide a device for removing a hollow base of a broken light bulb from a socket which may be employed with an extending element to eliminate the use of a ladder in removing such broken light bulb base from the socket.

The invention possesses other objects and advantages which will become apparent as the specification continues.

Reference is made to the following drawings which should be considered as depicting a preferred embodiment of the invention herein.

For a better understanding of the invention reference is made to the following detailed description of the preferred embodiments of the invention which should be taken in conjunction with the above described drawings.

DETAILED DESCRIPTION OF THE PREFERRED EMBODIMENTS OF THE INVENTION

Various aspects of the present invention are revealed from the following detailed description of the preferred embodiments and should be referenced to the prior delineated drawings.

Figure 1:
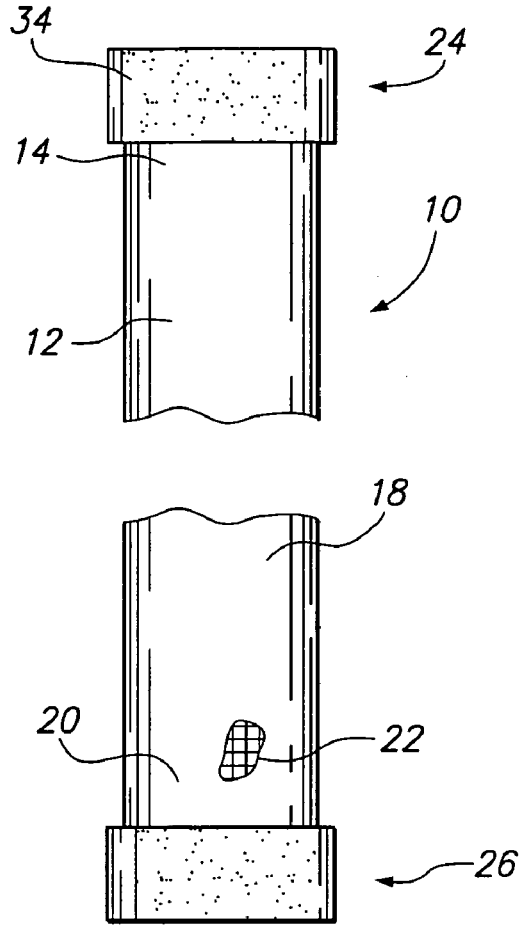
FIG. 1 is a broken side elevational view of the device of the present invention.
Figure 2:
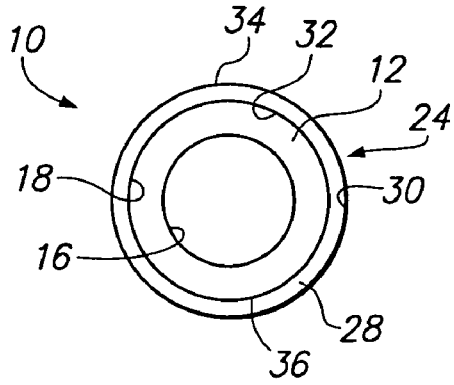
FIG. 2 is a top plan view of the device of the present invention.

The embodiment of the invention as a whole is depicted in the drawings by reference character 10, FIGS. 1 and 2. Device 10 includes as one of its elements an elongated member 12 which may take the form of a hollow cylindrical tube formed of a non-electrically conductive material such as polyvinyl chloride. Member 12 is formed with an end portion 14 possessing a diameter or transverse dimension which is compatible with the use of device 10, which will be described in greater detail hereinafter. With reference to FIG. 2, it may be observed that member 12 includes an inner surface 16 and an outer surface 18. With reference again to FIG. 1, it should be seen that member 12 further includes an end portion 20. It is intended that end portion 20 be gripped by the user of device 10. In this regard, knurled surface 22 may be formed on end portion 20 to aid in the gripping of member 12.

Device 10 is also formed with adhesive means 24 which is applied to outer surface 18 of member 12 at end portion 14. In the embodiment shown in FIG. 1, a duplicate adhesive means 26 is also shown on end portion 20 of member 12. Needless to say, the workability and functioning of adhesive means 24, which will be described hereinafter, will also apply to adhesive means 26. With further reference to FIG. 2, it may be observed that adhesive means 24 includes an endless tape band 28. Tape band 28 includes a first surface 30 and an opposite second surface 32. The first adhesive layer 34 affixes to first surface 30 of endless tape band 28. Likewise, a second adhesive layer 36 affixes to second surface 32 of endless tape band 28. Second adhesive layer 36 is employed to hold tape band 28 to surface 18 of member 12. Moreover, endless tape band 28 may be formed of a flexible or deformable polymeric foam material such as a foam tape 20 manufactured by 3M Company of Minneapolis, Minn. under the brand name Scotch Mounting Tape CAT#110. Of course, a release paper or other removable layer (not shown) may be wrapped around the outer first adhesive layer 34 on adhesive means 24, and is discarded prior to use.

Figure 3:
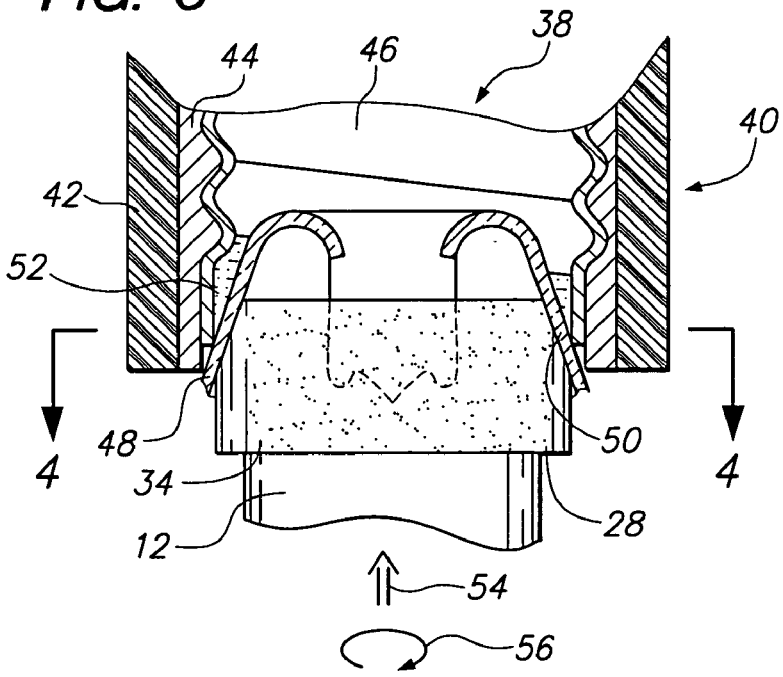
FIG. 3 is a sectional view of a broken light bulb in an electrical socket and showing a device of the present invention as engaging the piece of the broken light bulb.
Figure 4:
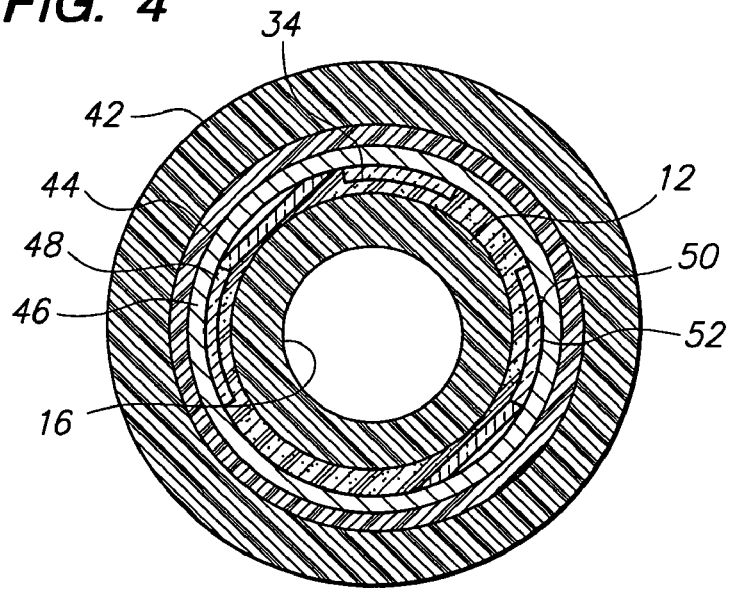
FIG. 4 is a sectional view taken along line 4—4 of FIG. 3.

In operation, the user grips end portion 20 of member 12 and contacts end portion 14 with the broken light bulb 38, FIG. 3. As shown in FIG. 3, a light socket 40 is depicted having an insulating base 42 and a metallic threaded insert 44, which is connected to the appropriate electrical conductors providing electrical power to socket 40 (not shown). Also included are chards of glass 48 and 50 which are remnants of the envelope of broken light bulb 38. A cementitious material 52 forms a layer between metallic hollow base 46 and glass chards 48 and 50. It may be observed, directional arrow 54 shows the initial movement of member 12 into hollow metallic base member 46. Tape band 28, having adhesive layer 34 thereupon, contacts metallic base 46, glass chards 48 and 50, as well as others, and cementitious layer 52. The resiliency of tape band 28 permits adhesive layer 34 to deform and to bond with all of the portions of broken light bulb 38 heretofore described. FIG. 4 further illustrates dates such contacting and bonding of adhesive layer 34 with the components of broken light bulb 38. Directional arrow 56 of FIG. 3 indicates the twisting or torsional force then applied to member 12 by the user of device 10 once the bonding of adhesive layer 34 has been achieved. Since adhesive layer 34 has now bonded to the components of broken light bulb 38, the turning of member 12 also turns metallic base 46 within socket insert 46. Broken light bulb 38 is then removed and discarded. Adhesive means 26 on the opposite end of member 12 may be used to remove another broken light bulb similar to broken light bulb 38 should adhesive means 24 become worn or disabled.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A device for removing a hollow base of a broken light bulb from a socket by the application of a torsional force, comprising:

a. a member, said member terminating in an end having an outer surface which is capable of extending into the hollow base of the broken light bulb, said member further comprising a portion capable of receiving the torsional force; and b. adhesive means applied to said outer surface of said end of said member, said adhesive means bonding with said hollow base of the broken light bulb, said member and said adhesive means turning with the application of said torsional force on said portion of said member.

2. The device of claim 1 in which said member comprises a hollow member.

3. The device of claim 2 in which said member comprises a cylinder.

4. The device of claim 1 in which said member is formed of non-electrically conductive material.

5. The device of claim 1 in which said adhesive means comprises a tape having a body possessing first surface and an opposite second surface, and further comprises a first adhesive layer affixed to said first surface and a second adhesive layer affixed to said second surface, said second adhesive layer holding said tape body to said outer surface of said end portion of said member, said first adhesive layer intended for contacting the hollow base of the broken light bulb.

6. The device of claim 5 in which said tape body comprises a resilient material.

7. The device of claim 5 in which said member comprises a hollow member.

8. The device of claim 5 in which said member comprises a cylinder.

9. The device of claim 5 in which said member is formed of non-electrically conductive material.

10. The device of claim 6 in which said member comprises a hollow member.

11. The device of claim 6 in which said member comprises a cylinder.

12. The device of claim 6 in which said member is formed of non-electrically conductive material.

* * * * *